US005819573A

United States Patent [19]

Seaman

[11] Patent Number: 5,819,573

[45] Date of Patent: Oct. 13, 1998

[54] HYDRAULIC FORMING OF WORKPIECES FROM SHEET METAL

[76] Inventor: Roy C. Seaman, 11 E. Orange Grove Rd., Tucson, Ariz. 85704

[21] Appl. No.: 877,299

[22] Filed: Jun. 17, 1997

[51] Int. Cl.[6] ..... B21D 26/02

[52] U.S. Cl. ..... 72/60; 72/57

[58] Field of Search ..... 72/57, 60, 63

[56] References Cited

U.S. PATENT DOCUMENTS

| | | | |
|---|---|---|---|
| 3,373,480 | 3/1968 | Fuchs | 72/60 |
| 3,383,891 | 5/1968 | Geitz | 72/60 |
| 3,494,160 | 2/1970 | Tominaga et al. | 72/60 |
| 3,561,239 | 2/1971 | Tominaga et al. | 72/60 |
| 3,673,834 | 7/1972 | Brunner et al. | 72/57 |
| 4,788,843 | 12/1988 | Seaman . | |
| 5,540,075 | 7/1996 | Hall, Jr. | 72/63 |

FOREIGN PATENT DOCUMENTS

| | | | |
|---|---|---|---|
| 4134596 | 4/1993 | Germany | 72/60 |

*Primary Examiner*—David Jones
*Attorney, Agent, or Firm*—Rockey, Milnamow & Katz, Ltd.

[57] ABSTRACT

An apparatus and method for forming contoured work pieces from a flat sheet metal stock includes a die block having a cavity into a planar surface of the die block, and a pressure chamber, the die block and pressure chamber relatively reciprocable to clamp the flat sheet metal stock. The pressure chamber is flow connected to a hydraulic cylinder via a spring loaded ball valve. A reciprocating plunger rod is connected to a hydraulic actuator and positioned to be thrust into the volume of the hydraulic cylinder to increase the pressure within the hydraulic cylinder which in turn opens the ball valve, and by hydraulic pressure, deforms the flat workpiece into the die cavity. An apparatus is described which can include three operational stations, a first station for a punch deformation of the flat workpiece to effectively stretch the workpiece within an area, a hydraulic forming operation for using hydraulic pressure to deform the flat workpiece into a die cavity, and finally a punch cutting station for separating the thus formed workpiece from the otherwise flat sheet metal. The three operational stations are activated by a single stroke of a hydraulic cylinder and the metal sheet is indexed continuously through the three stations.

24 Claims, 3 Drawing Sheets

HYDRAULIC FORMING OF WORKPIECES FROM SHEET METAL

FIELD OF THE INVENTION

The present invention relates to a process and apparatus for forming shaped workpieces from sheet metal stock and particularly to a press apparatus for deforming flat sheet metal stock to form contoured workpieces.

BACKGROUND OF THE INVENTION

Reciprocating punch presses to indent sheet metal to form workpieces, wherein a driven punch element impacts and deforms the sheet metal according to the punch element and a die arranged beneath the sheet metal, are known. In these devices the cooperating surfaces of the reciprocating punch and die must be precisely configured to achieve the desired deformation of the sheet metal. Since the punch, in cooperation with the die, defines the surface shapes and irregularities of the finished workpiece, such punch and die must be changed out as a pair when changing the shape of the workpiece. It would be desirable to provide a punch which was flexibly adaptable to different shapes without requiring such a change to a different punch.

A reciprocating punch exerts a forming force in an axial direction to the movement of the punch. Depending on the shape of the cooperating die, such a punch can cause uneven stretching, shear on fatigue on the workpiece within the die during formation. It would be desirable to provide a forming press for deforming a flat sheet metal stock which deforms the flat sheet metal stock with a more uniform forming pressure than contact deforming by a reciprocating punch. Additionally, a high degree of accuracy in machining is needed to contour the punch to precisely match the die cavity. It would be desirable to reduce the requirement for machining accuracy needed to construct a punch and die which utilize a deformation of sheet metal stock into a die cavity.

It would be desirable to provide a forming tool for deforming workpieces from a sheet metal supply which eliminated impact by a reciprocating punch so as to provide a quieter machine. It would be desirable to provide such a forming tool which deforms concavities in sheet metal smoothly and without undue shear and tensile stresses, particularly around the periphery of a corresponding concavity in an underlying die.

A reciprocating mechanical punch deforms sheet metal stock in a direction of reciprocation. It would be desirable to provide a punch-type tool which is not limited by its physical shape but can deform a flat sheet metal stock into more complex concavities.

U.S. Pat. No. 4,788,843 to Seaman et al. describes a method and apparatus for hydraulically forming metallic tubular bodies. An openable tubular die having an inside channel configured to receive a tubular body is arranged to be pressurized with liquid, preferably water. A forming plunger is inserted into the tubular body within the tubular die creating localized hydraulic pressurization of the liquid within the body. This pressurization causes outward deformation of the body toward the interior of the cylindrical die. The die is provided with concavities, tapers, steps and projections such that the tubular body is formed accordingly by the hydraulic pressurization of the liquid held therein.

It would be desirable to provide a forming tool which forms concave workpieces from flat sheet metal stocks using hydraulic pressure.

SUMMARY OF THE INVENTION

The present invention provides a method and apparatus for hydraulically forming and shaping a workpiece from a flat sheet metal stock by urging the sheet metal stock against a forming die using hydraulic pressure against the sheet metal stock on a side of the sheet metal stock opposite the forming die. The method of the present invention is practiced using a relatively simple apparatus which can replace more complex known punch pressing apparatus. The invention provides a reciprocable pressure chamber which together with a die block, clamps the sheet metal stock therebetween. Hydraulic fluid within a volume open to the pressure chamber is pressurized by the forced insertion of a rod into the volume. The resultant pressurized fluid exerts force against the sheet metal stock to form the workpiece.

The present apparatus provides in a first embodiment a main hydraulic cylinder having a reciprocating piston therein, the piston extending externally of the main hydraulic cylinder with a neck which optionally holds a punch cluster at a distal end thereof. The piston and neck include a central channel open to an inside of the main cylinder and filled with hydraulic fluid. This channel terminates in a nozzle portion having a spring-loaded valve which closes the throat of the nozzle portion until a preselected pressure is reached within the main cylinder.

Surrounding an open end of the nozzle is a cup-shaped workpiece pressure chamber having a substantially flat surrounding rim. The cup-shaped chamber is supported on or formed with a punch cluster plate connected to the neck. Also optionally formed with or mounted on the cluster plate is a forming punch and a cutting punch. Beneath the pressure chamber, the forming punch and the cutting punch is arranged the sheet metal stock to be worked. Beneath the sheet metal stock to be worked is arranged a cluster of dies including: a forming die, a pressure die and a cutting die, one each in registry with the forming punch, pressure chamber, and cutting punch respectively. The sheet metal stock is progressed or indexed in strip form across the three dies. It will be understood, however, that the present apparatus can be configured to only effect hydraulic deformation of a workpiece, without concomitant punching and cutting, as in the illustrated embodiment.

In a first step, the sheet metal is formed into a square, wave-shaped area by the forming punch and corresponding forming die. The forming punch stretches the surface area of the sheet metal stock. The sheet metal stock is then progressed ("indexed") a distance so the wave-shaped area is in a position between the pressure chamber and corresponding pressure die wherein the wave-shaped area is held between the pressure chamber and pressure die. The pressure die has a concavity therein which is shaped according to the desired contour of the workpiece. The piston within the main cylinder is lowered and the pressure chamber clamps the sheet metal stock onto the pressure die.

Hydraulic fluid is diverted into the main cylinder to essentially fill the main cylinder. The main cylinder is then pressurized further by a rod-like member which is forcibly inserted into the main cylinder. The physical volume of the rod inserted into the main cylinder requires a corresponding increase in volume of the main cylinder, particularly when using a substantially incompressible fluid, and increases the pressure within the main cylinder dramatically. This hydraulic pressure overcomes the preselected set pressure of the valve element, which releases hydraulic fluid into the pressure chamber at a great pressure. The increase in volume is supplied by the distorted sheet metal stock. This hydraulic fluid deforms the workpiece smoothly and quickly from the square, wave-shaped area into the concavity of the pressure die. Because the workpiece had been predistorted by the forming die, cracking or splitting due to stretching of the sheet metal during pressure forming is reduced.

The workpiece is next progressed to the cutting punch and cutting die wherein the precise shaped piece is cut from the metal stock and deployed to a storage area. Thus, in the punch forming of the workpiece, no metal-to-metal impact or pressing occurs between a workpiece forming punch and the sheet metal. Instead, the large hydraulic pressure applied by the nozzle into the pressure chamber deforms the workpiece into the concavity of the pressure-forming die. When shear stress and cracking are not of concern, the forming punch and forming die can be eliminated, such as when a ductile metal is used and/or when the pressure die cavity is relatively shallow.

The invention provides an effective workpiece forming apparatus and method which eliminates the need for contact punching of workpieces between precisely shaped punches and dies. According to the present invention, the prior known contact punch is replaced by a hydraulic fluid which, by pressure, deforms a sheet metal stock into a die cavity.

Other features and advantages of the present invention shown will become readily apparent from the following detailed description, the accompanying drawings, and the appended claims.

DETAILED DESCRIPTION OF THE PREFERRED EMBODIMENTS

Figure 1:
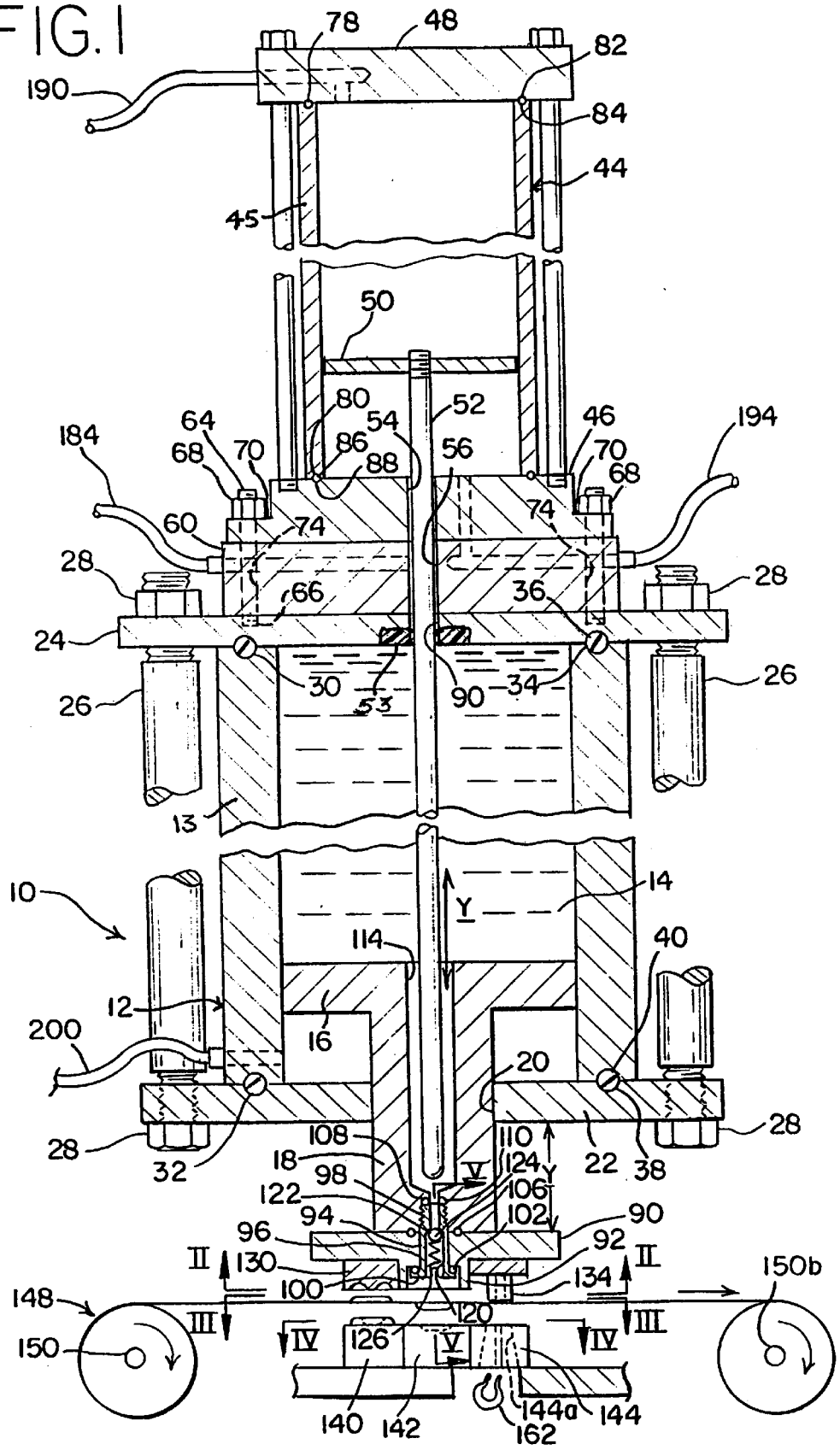
FIG. 1 is a schematic sectional view of a hydraulic forming tool of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

FIG. 1 illustrates a pressure-forming tool 10 of the present invention. The pressure-forming tool 10 includes a main cylinder 12 holding a working fluid 14 (which may comprise water) therein. Carried within the cylinder 12 is a main piston 16 having a depending neck 18 protruding through a hole 20 through a bottom plate 22 of the cylinder 12.

A tube 13 of the cylinder 12 is sealingly clamped between the bottom plate 22 and a top plate 24 by threaded studs 26 secured by nuts 28 at both ends. Four such studs 26 are used in a rectangular pattern. The tube 13 is circular in cross section and sealed at a top end thereof by an annular top O-ring 30, and at a bottom end thereof by an annular bottom O-ring 32. The tube 13 provides an annular seat 34 in registry with an annular seat 36 of the top plate 24 for fitment of the top O-ring 30. The bottom plate 22 includes an annular seat 38 in registry with an annular seat 40 of the tube 13 for fitment of the bottom O-ring 32.

A top mounted preferably pneumatic cylinder 44, having a tube 45 held between a stepped bottom plate 46 and a top plate 48, holds a second piston 50 reciprocably therein. The second piston is attached such as by threads to a plunger rod 52 which extends through a central bore 54 of the stepped bottom plate 46. A neoprene seal 53 sealingly engages the rod 52, with fluid pressure within the main cylinder 12 acting to enhance this seal. The central bore 54 is in registry with a central bore 56 of a mounting plate 60 arranged between the stepped bottom plate 46 and the top plate 24 of the main cylinder 12. The mounting plate 60 is clamped between the stepped top plate 46 and the top plate 24 of the main cylinder 12 by a plurality of threaded studs 64, four arranged in a rectangular pattern. The studs 64 are fixed into tapped holes 66 of the top plate 24 at one end thereof, and tightened by a nut 68 at a top end thereof against a shoulder 70 of the stepped top plate 46. Appropriate plain through bores 74 are provided through the shoulders 70 of top plate 46 and the mounting plate 60. The top cylinder 44 also includes an O-ring 78 between the top plate 48 and the tube 45; and an O-ring 80 between the tube 45 and the stepped bottom plate 46. The O-ring 78 resides in annular seats 82, 84 of the top plate 48 and the tube 45 respectively; and the O-ring 80 resides in seats 86, 88 of the cylinder 44 and the stepped bottom plate 46 respectively. The top plate 24 of the main cylinder 12 includes a central aperture 90 which closely surrounds the plunger rod 52.

At a distal end of the neck 18 is mounted a punch cluster plate 90 having a cup-shaped pressure chamber 92 opened downwardly and having a planar rim. An elongate nozzle 94 penetrates a central bore 96 of the cluster plate through the cup-shaped pressure chamber and threads into the neck 18 via a threaded end portion 98 thereof. At an end of the nozzle 94 opposite the threaded end portion 98 is a shoulder 100 which presses an O-ring 102 against the pressure chamber 92. The nozzle portion 96 thereby holds the cluster plate 90 tightly against the neck 18 via a further O-ring seal 106 therebetween. At a terminal end of the threaded end portion 98 a still further O-ring 108 is applied between nozzle 94 and an inner shoulder 110 of the neck 18. The neck 18 includes a central channel 114 which is open into the nozzle 94 at one end and open into the cylinder 12 as an opposite end thereof.

Figure 5A:
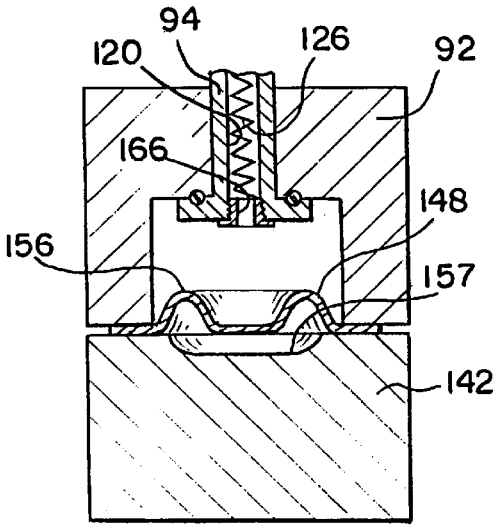
FIG. 5*a* is a sectional view taken generally along line 5—5 in FIG. 1 showing an initial stage of pressure forming.

The nozzle 94 includes a through bore 120 having an inside shoulder 122 at a top end thereof, and a ball 124 pressed against the inside shoulder 122 by a spring 126 held within the nozzle 94 and secured at an end opposite the ball 124, in the nozzle 94 as shown in FIG. 5*a*. Thus, the ball 124 is resiliently urged against the inside shoulder 122 to close the bore 120. The spring 126 is preselected to allow the ball 124 to pass hydraulic fluid through the bore 120 only at a specified pressure. The arrangement thus functions as a pressure-responsive check valve.

Adjacent the pressure chamber 92 on the cluster plate 90 is attached a forming punch 130 on one side thereof, and a cutting punch 134 on a respective opposite side thereof. Arranged beneath the forming punch 130, pressure chamber 92 and cutting punch 134 are: a forming die 140, a pressure die 142, and a cutting die 144, respectively. The cluster plate 90 therefore optionally provides three stations: a mechanical deforming station, corresponding to the forming punch and die; a pressure deforming station, corresponding to the pressure chamber and die, and a cutting station corresponding to the cutting punch and die.

In operation, a supply of sheet metal stock 148, such as from a sheet metal coil 150*a*, is indexed across the three stations. The piston 16 is moved downwardly in the direction Y by pressurization of fluid 14 within the cylinder 12 by insertion of rod 52 into the cylinder by actuation of pneumatic cylinder 44. Suitable microswitches (not shown) can be provided to facilitate operation of the pneumatic cylinder 44. During a stroke, the forming punch 130, in cooperation with the forming die 140, presses a raised square, wave-shaped area 156 in the sheet metal at the first station. The sheet metal is indexed further and the square wave-shaped area 156 is next placed between the pressure chamber 92 and the pressure die 142. The piston 16 is again lowered to clamp tightly the sheet metal stock between the pressure chamber 92 and the pressure die 142. At this time the plunger rod 52 is forcibly lowered into the cylinder 12, thus increasing the pressure within the cylinder. The increased pressure within the cylinder forces open the ball 124 from the inside shoulder 122 to release high pressure fluid into the pressure chamber 92 and against the sheet metal, particularly the area of the square, wave-shaped 156 area to deform the sheet metal stock into a cavity 157 of the pressure die 142 to form the desired workpiece shape. Upon completion, the plunger rod 52 is withdrawn upwardly, the pressure is decreased and the ball 124 seats against the shoulder 122, and the piston 16 is raised. The metal stock 148 is rolled into a scrap coil 150*b*.

The sheet metal stock is further indexed and the thus formed workpiece is moved to the cutting station whereupon during the next stroke, the cutting punch 134 descends through the sheet metal stock 148 in cooperation with the cutting die 144 to separate the workpiece from the sheet metal stock. During each stroke, all three stations are in use and the indexing is continuous for assembly production of workpieces.

Figure 2:
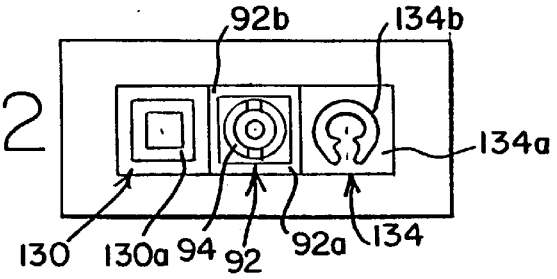
FIG. 2 is a sectional view taken generally along line 2—2 in FIG. 1.

FIG. 2 illustrates the end faces of the three operable stations of the apparatus: the forming punch 130 having an undulating square punch head 130*a*; the pressure chamber 92 having a square surrounding wall 92*a* with a planar rim 92*b*; and the cutting punch 134 with a base block 134*a* and an extending hollow, shaped cutter 134*b*. The nozzle 94 provides slots 94*a*, 94*b* for engagement by a tool to screw in/out the nozzle for replacement or adjustment.

Figure 3:
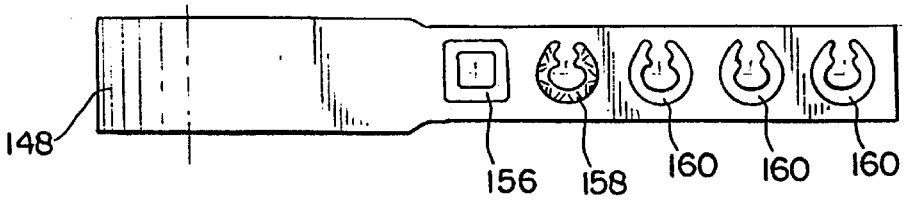
FIG. 3 is a sectional view taken generally along line 3—3 of FIG. 1.

FIG. 3 shows the sheet metal stock which is indexed through the forming stations. The raised square, wave-shaped area 156 is shown after being formed by the forming punch 130 and forming die 140. A pressure formed workpiece shape 158 is shown as formed by the cooperation of the pressure chamber 92 and the pressure die 142 as described above. Finally, a void 160 is shown where a finished workpiece 162 as shown in FIG. 1, has been cut from the sheet metal supply stock 148. Further voids 160 are shown spaced lengthwise along the same sheet metal stock 148.

Figure 4:
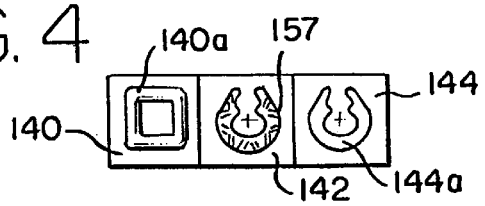
FIG. 4 is a sectional view taken generally along line 4—4 of FIG. 1.

FIG. 4 illustrates the die profiles for the forming die 140, the pressure die 142, and the cutting die 144. These dies, of course, can be changed out simply by unscrewing the nozzle 94 from the neck 18 and removing the punch cluster plate 90 and replacing the plate with a different one holding different dies. Another advantage of the invention is that the nozzle 94 can easily be replaced with a solid punch member to convert the operation of the forming tool from a hydraulic pressure forming tool to a conventional punch type press. The forming die 140 includes an undulating surface 140*a* for meshing with the undulating head 130*a* of the forming punch 130. The pressure die 142 includes the forming cavity 157 having the preselected forming shape and contour of the workpiece to be formed. The cutting die 144 includes a shaped void 144*a* therethrough to receive the cutting punch 134 and to separate and transport therethrough the severed workpiece 162. An appropriate container or other workpiece receiving station can be arranged beneath the cutting die 144.

FIG. 5*a* shows the pressure chamber 92 clamped down against the pressure die 140 with the sheet metal stock 148, particularly the square, wave-shaped area 156 located therein. This square, wave-shaped area 156 is preformed before reaching the pressure station and is necessary only when the particular metal material of the sheet metal stock fatigues rapidly or if the pressure die 142 is excessively deep. This is due to the fact that if the sheet metal stock is held flat over the die cavity, and bound around the outer edges of the cavity, it must be stretched to enter the cavity and will have a reduction of wall thickness or possibly fatigue to the breaking point. When a sufficiently ductile metal is used, or the pressure die 142 is sufficiently shallow, the deforming station can be eliminated, i.e., the forming punch 130 and forming die 140 can be eliminated.

The spring 126 in the nozzle 94 is shown in FIG. 5*a* to be held in by a screwed-in, spring retaining sleeve 166 threaded into the bore 120 of the nozzle 94 at an open end thereof.

Figure 5B:
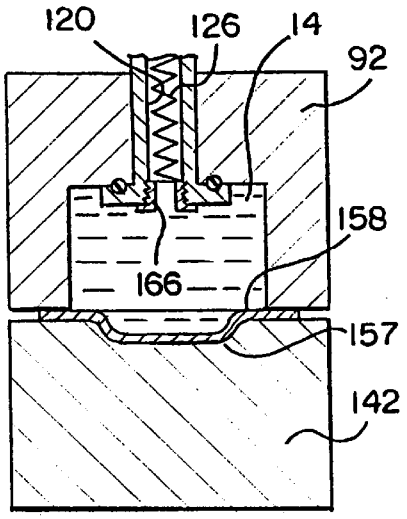
FIG. 5*b* is a sectional view taken generally along line 5—5 of FIG. 1 showing a secondary stage of pressure forming.

FIG. 5*b* illustrates the formed workpiece 158 having been deformed under influence of hydraulic fluid 14 within the pressure chamber 92, the hydraulic fluid having deformed the workpiece shape 158 into the die cavity 157 within the pressure die 142.

Figure 6B:
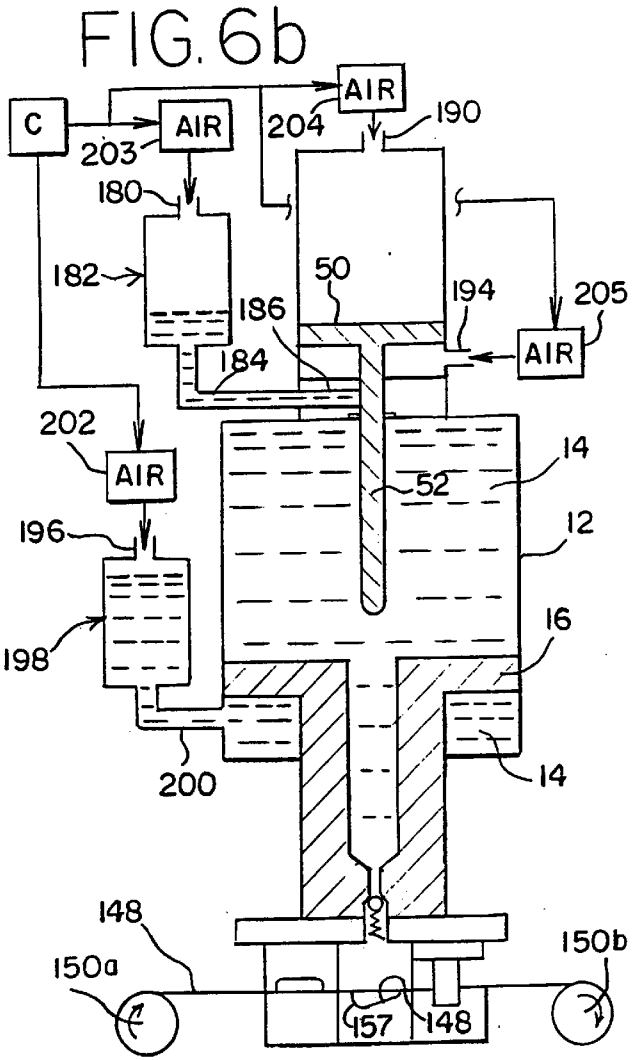
FIG. 6*b* is a schematic operational view of the apparatus shown in FIG. 6*a* in a second stage of operation.
Figure 6A:
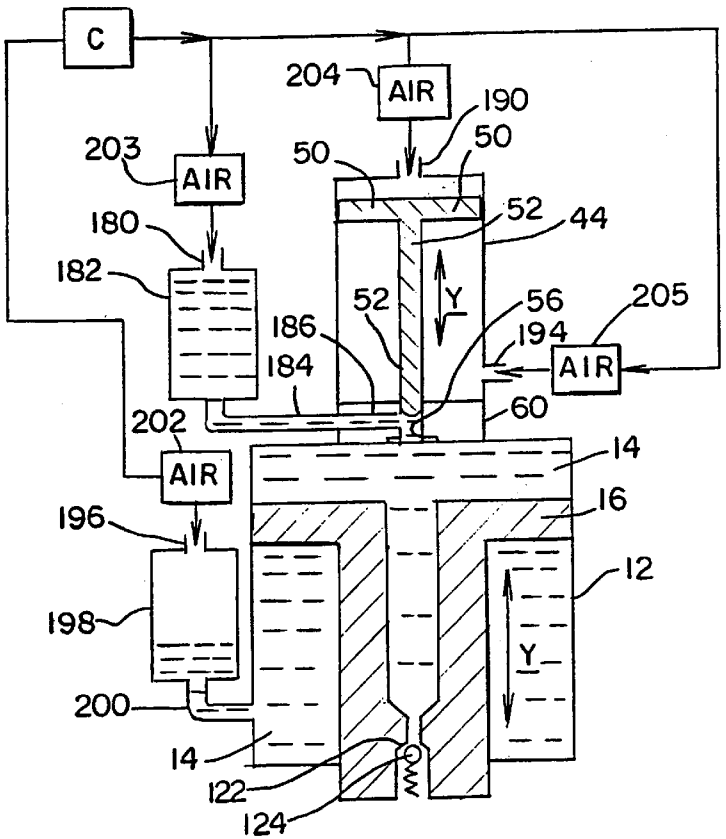
FIG. 6*a* is a schematic operational diagram of the apparatus of FIG. 1 showing a first stage of operation.

FIG. 6*a* and 6*b* illustrate the operation of the pressure forming tool of the present invention. Initially, compressed air is delivered into a top port 180 of a pressure fluid reservoir 182 which is connected at a bottom thereof into the bore 56 by a pressure conduit 184 and internal channeling 186 of the mounting block 60. The compressed air forces hydraulic piston 16 downwardly as the cylinder 12 fills with hydraulic fluid 14 above the piston 16. When the piston comes to a stop in its bottom position, with the pressure chamber 92 clamping the sheet metal stock against the pressure die 142, compressed air is automatically transferred to the top cylinder 44 at inlet port 190. Compressed air forces the top piston 50 downwardly which in turn forces the insertion rod 52 downwardly into the hydraulic cylinder 12. As described above, the insertion increases the pressure within the cylinder 12 above the piston 16 dramatically, which unseats the ball 124 from the shoulder 122 and injects high pressure fluid within the pressure chamber 92 to fill the chamber 92 and deform the sheet metal stock 148 into the pressure die cavity 157. Opening of the check valve provided by ball 124 and shoulder 122 can be effected at about 80% of the capacity of the hydraulic cylinder 12.

When the workpiece shape 158 is formed, the piston 50 is returned to its retracted, elevated position either manually or automatically by injecting compressed air into a port 194. Compressed air is then injected into a port 196 of a bottom reservoir 198 which forces hydraulic fluid into the cylinder 12 on the bottom side of the piston 16 to upwardly thrust the piston 16 within the cylinder 12, to the starting position. The bottom reservoir 198 is flow connected by a hydraulic line 200 into the cylinder 12 beneath the piston 16.

During operation, the downward movement of the piston 16 displaces hydraulic fluid 14 which resides beneath the piston 16 into the reservoir 198, and an upward movement of the piston 16 displaces hydraulic fluid 14 residing above the piston 16 within the cylinder 12 into the reservoir 182. Thus, by providing reservoirs 182, 198, the hydraulic fluid 14 is contained during the up and down movement of the piston 16.

The switching between the starting position shown in FIG. 6*a* and the ending or pressure forming position shown in FIG. 6*b* can be undertaken by automatic switches which either react to the actual vertical displacement of the plunger 52 and the vertical displacement of the piston 16, or can be undertaken by hydraulic pressure switches which, for example, retract the top piston 50 when a certain desired pressure is reached within the cylinder 12. These microswitches and pneumatic/hydraulic controls are readily configured by one skilled in the art, given the disclosure of the present invention. The switches are represented by a control system C indicated in the FIGS. 6*a* and 6*b*, and signal connected to the air supplies 202, 203, 204, 205 to input compressed air in a synchronized fashion.

For the embodiments shown in FIGS. 1–6*b*, the invention can advantageously use as hydraulic fluid, a water and a water-soluble oil mixture, such as an anti-freeze mixture which can be circulated with a standard coolant pump. It is advantageous to use a water mixture rather than customary hydraulic oil since there is a loss of liquid in the sheet metal forming process. The water soluble solution is less expensive and preferable regarding disposing of excess or spilled fluid.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A hydraulic forming apparatus for shaping a workpiece, from a planar piece comprising:

a die block having an element forming cavity;

a press tool having a portion arranged to be mated with said die block, and having a volume therein for holding fluid, and an opening located on said portion thereof, said opening in fluid communication with said volume, said opening located to register with said cavity when said pressure tool is held against said die block;

a reciprocating plunger arranged to be inserted into said volume to increase hydraulic pressure of said fluid within said volume, to deform a workpiece placed between said opening and said cavity; and a valve element, said valve element closing said opening, and a spring arranged between said valve element and said portion, urging said valve element to close said opening.

2. The apparatus according to claim 1 wherein said cavity is closed by said workpiece, said portion pressing said workpiece against said die block around said cavity.

3. The apparatus according to claim 1, wherein said press tool is guided to relatively reciprocate toward and away from said die block, said portion shaped to press said workpiece against workpiece against said die block.

4. The apparatus according to claim 1, further comprising a hydraulic cylinder, and said press tool includes at a base end opposite said portion a hydraulic piston, said hydraulic piston reciprocable within said hydraulic cylinder to move said portion toward and away from said die block, and fluid supply lines connected into hydraulic cylinder on opposite sides of said hydraulic piston to allow injection of hydraulic fluid into said hydraulic cylinder to selectively reciprocate said hydraulic piston in opposite directions within said hydraulic cylinder.

5. The apparatus according to claim 1 further comprising a forming punch connected for movement with said portion and reciprocable therewith for deforming said workpiece, and a punch die arranged below said forming punch, said die shaped to elongate a surface area of a workpiece when mated with said forming punch.

6. The apparatus according to claim 1 further comprising a cutting punch arranged for movement with said portion and reciprocable for cutting a shaped piece from said workpiece.

7. A hydraulic forming apparatus for shaping a flat workpiece, comprising:

a die block having an element forming die cavity formed into a flat surface;

a press tool having on a distal end thereof a planar surface arranged to be mated with said surface of said die block, and having a volume therein for holding fluid, and an opening located through said planar surface, said opening in fluid communication with said volume, said opening located to register with said die cavity when said press tool is held against said die block, said planar surface clamping said flat workpiece against said flat surface of said die block, said press tool being guided to relatively reciprocate toward and away from said die block; and a reciprocating plunger arranged to be inserted into said volume to increase hydraulic pressure of said fluid in said volume, said hydraulic fluid to deform the workpiece into said die cavity.

8. The apparatus according to claim 7 wherein said reciprocating plunger and said die block are mounted to a reciprocating mechanism and said press tool is held stationary.

9. The apparatus according to claim 7 wherein said press tool is guided to relatively reciprocate toward and away from said die block; and further comprising a hydraulic cylinder mounted to said press tool and having a piston therein connected to said reciprocating plunger for driving said plunger into said press tool volume.

10. The apparatus according to claim 7 further comprising a main hydraulic cylinder; and wherein said press tool is guided to relatively reciprocate toward and away from said die block, said press tool comprising a piston reciprocable within said main hydraulic cylinder, and further comprising hydraulic fluid reservoirs flow connected to said main hydraulic cylinder on opposite sides of said hydraulic piston to accumulate hydraulic fluid in response to movement of said hydraulic piston.

11. The apparatus according to claim 7 further comprising a valve element closing said opening, and a spring arranged between said valve element and a portion of said press tool to urge closed said valve element to said opening, said spring sized to allow said valve element to pass hydraulic fluid through said opening at a preselected pressure within said volume.

12. The apparatus according to claim 7 further comprising a main hydraulic cylinder and said press tool includes at a base end opposite said opening a hydraulic piston, said hydraulic piston reciprocable within said main hydraulic cylinder, and pressure lines connected into said hydraulic cylinder on opposite sides of said hydraulic piston to selectively reciprocate said hydraulic piston in opposite directions within said main hydraulic cylinder.

13. The apparatus according to claim 12 wherein said main hydraulic cylinder is flow open to said volume of said press tool on one side of said hydraulic piston.

14. The apparatus according to claim 7 further comprising a punch connected to said press tool laterally of said opening and reciprocable with the press tool for deforming said flat workpiece, and a punch die arranged below said punch, said die shaped to deform said workpiece into an elongated surface area within a flat area.

15. The apparatus according to claim 7 further comprising a cutting punch arranged on said press tool laterally of said opening and reciprocable for cutting a shaped piece from said flat workpiece.

16. A method for forming a workpiece from a flat sheet metal stock, comprising the steps of:

providing a die block having a contoured cavity open on one side;

providing a press tool arranged facing said die block and having a volume for holding a hydraulic fluid, and an opening in registry with said contoured cavity, said opening in fluid communication with said volume;

providing a movable member insertable into said volume to raise hydraulic pressure within said volume;

pressing said press tool against said flat sheet metal stock to clamp said flat sheet metal stock into said die block with said sheet metal stock interposed between said opening and said contoured cavity;

moving said movable member into said volume to increase said hydraulic pressure to a pressure sufficient to deform said flat sheet metal stock into said contoured cavity; and arranging a pressure valve between said opening and said volume, said pressure valve separating said opening and said volume until hydraulic pressure within said volume has reached a predetermined amount; and said step of deforming said flat sheet metal stock is further defined in that said pressure valve is opened to release pressurized hydraulic fluid against said flat sheet metal stock.

17. The method according to claim 16 comprising the further step of before the step of pressing said press tool, placing said flat sheet metal stock in a deforming die, and using a deforming punch, stretching a surface area of said flat sheet metal stock within an area to be placed within said contoured cavity.

18. The method according to claim 17 comprising the further steps of providing a cutting die, and subsequent to the flat sheet metal stock being deformed into said contoured cavity, indexing said flat sheet metal stock to said cutting die, and arranging a cutting punch above said cutting die, and stroking said cutting punch to separate said workpiece from said flat sheet metal stock.

19. The method according to claim 16 wherein said step of providing a press tool is further defined in that said press tool comprises a hydraulic cylinder and a reciprocating piston having a neck portion extending externally of said hydraulic cylinder, said piston and said neck portion having a through-channel from said hydraulic cylinder to said opening, said volume defined by said hydraulic cylinder and said piston above said piston, and said step of providing a movable member is further defined in that movable member comprises an elongate rod insertable into said hydraulic cylinder above said piston;

and including the further step of increasing hydraulic pressure above said piston within said hydraulic cylinder to drive said neck portion downwardly to clamp said flat sheet metal stock to said pressure die;

wherein said step of moving said movable member is further defined by the step of driving said elongate rod into said hydraulic cylinder;

and including the further steps of after said flat sheet metal stock is formed into said contoured cavity, retracting said elongate rod from said hydraulic cylinder; and raising hydraulic pressure beneath said piston within said cylinder to raise said piston and neck portion from said sheet metal stock.

20. An apparatus for hydraulically deforming a metallic workpiece, comprising:

a press tool comprising a hydraulic cylinder and reciprocable piston therein, said piston including a portion engageable with said workpiece, said tool including check valve means in said piston responsive to fluid pressure in said hydraulic cylinder; and means for pressurizing said hydraulic cylinder for moving said piston against said workpiece, said check valve means opening after engagement of said piston with said workpiece so that pressurized fluid from said hydraulic cylinder flows through said check valve means and against said workpiece for effecting hydraulic deformation thereof.

21. An apparatus for hydraulically deforming a workpiece in accordance with claim 20, wherein said pressurizing means comprises a plunger insertable into said hydraulic cylinder, said press tool including seal means in engagement with said plunger.

22. An apparatus for hydraulically deforming a workpiece in accordance with claim 21, wherein said pressurizing means further comprises a pneumatic actuator for inserting said plunger into said hydraulic cylinder.

23. A hydraulic forming apparatus for shaping a workpiece, from a planar piece comprising:

a die block having an element forming cavity;

a press tool having a portion arranged to be mated with said die block, and having a volume therein for holding fluid, and an opening located on said portion thereof, said opening in fluid communication with said volume, said opening located to register with said cavity when said pressure tool is held against said die block;

a reciprocating plunger arranged to be inserted into said volume to increase hydraulic pressure of said fluid within said volume, to deform a workpiece placed between said opening and said cavity; and a hydraulic cylinder, and said press tool includes at a base end opposite said portion a hydraulic piston, said hydraulic piston reciprocable within said hydraulic cylinder to move said portion toward and away from said die block, and fluid supply lines connected into said hydraulic cylinder on opposite sides of said hydraulic piston to allow injection of hydraulic fluid into said hydraulic cylinder to selectively reciprocate said hydraulic piston in opposite directions within said hydraulic cylinder, wherein said hydraulic cylinder is flow open to said volume of said press tool on one side of said hydraulic piston.

24. A hydraulic forming apparatus for shaping a workpiece, from a planar piece comprising:

a die block having an element forming cavity;

a press tool having a portion arranged to be mated with said die block, and having a volume therein for holding fluid, and an opening located on said portion thereof, said opening in fluid communication with said volume, said opening located to register with said cavity when said pressure tool is held against said die block;

a reciprocating plunger arranged to be inserted into said volume to increase hydraulic pressure of said fluid within said volume, to deform a workpiece placed between said opening and said cavity; and a forming punch connected for movement with said portion and reciprocable therewith for deforming said workpiece, and a punch die arranged below said forming punch, said die shaped to elongate a surface area of a workpiece when mated with said forming punch.

* * * * *